US006806213B2

(12) United States Patent
Brooks

(10) Patent No.: US 6,806,213 B2
(45) Date of Patent: Oct. 19, 2004

(54) DISPOSABLE WASH CLOTH AND METHOD OF USING

(75) Inventor: JoAnn Adele Brooks, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 189 days.

(21) Appl. No.: 10/037,384

(22) Filed: Dec. 20, 2001

(65) Prior Publication Data

US 2003/0119395 A1 Jun. 26, 2003

(51) Int. Cl.[7] ..... B32B 27/04; B32B 27/12; D04H 1/00

(52) U.S. Cl. ..... 442/121; 442/123; 442/165; 442/415; 424/402; 15/209.1

(58) Field of Search ..... 442/121, 123, 442/165, 415; 424/402; 15/209.1

(56) References Cited

U.S. PATENT DOCUMENTS

| | | | | |
|---|---|---|---|---|
| 4,496,576 | A | 1/1985 | Loncrini et al. | |
| 5,391,198 | A | 2/1995 | Cheney, III et al. | |
| 5,429,628 | A | 7/1995 | Trinh et al. | |
| 5,702,992 | A | 12/1997 | Martin et al. | |
| 5,714,445 | A | 2/1998 | Trinh et al. | |
| 5,906,278 | A | 5/1999 | Ponsi et al. | |
| 5,956,794 | A | 9/1999 | Skiba et al. | |
| 6,029,809 | A | 2/2000 | Skiba et al. | |
| 6,183,766 | B1 | 2/2001 | Sine et al. | |
| 6,206,863 | B1 | 3/2001 | Skewes et al. | |
| 6,207,274 | B1 | 3/2001 | Ferenc et al. | |
| 6,284,749 | B1 * | 9/2001 | Castillo et al. | 514/159 |
| 6,361,784 | B1 * | 3/2002 | Brennan et al. | 424/402 |
| 6,432,395 | B1 * | 8/2002 | Rochon et al. | 424/70.19 |

FOREIGN PATENT DOCUMENTS

| | | | |
|---|---|---|---|
| WO | WO 99/66793 | A1 | 12/1999 |
| WO | WO 00/47183 | A1 | 8/2000 |
| WO | WO 00/64408 | A1 | 11/2000 |
| WO | WO 01/23510 | A2 | 4/2001 |
| WO | WO 01/28338 | A2 | 4/2001 |
| WO | WO 01/28339 | A2 | 4/2001 |
| WO | WO 01/28340 | A2 | 4/2001 |
| WO | WO 01/28552 | A2 | 4/2001 |
| WO | WO 01/48025 | A1 | 7/2001 |

OTHER PUBLICATIONS

Patent Abstract of JP 02–036111B4: Description of Takasago Corp., "Perfume Compsotion of Hydrophobic Gel".

Patent Abstracts of Japan JP 61–056121 A2: Description of Kawachi Tatsujiro, "Perfume Compsotion of Hydrophobic Gel." Aurigin® Summary Page attached.

Patent Abstracts of Japan JP 62–263143 A2: Description of Murata Shoichi et al., "Cyclodextrin Clathrate Compound".

Aurigin® Summary Page of Japan JP 02–779424 B2: Description of Isane Takanori et al., "Alpha–Tocopherol Vitamin A Acid Ester–Cyclodextrin Complex".

Mufti, Jabbar; Cernasov, Domnica; Macchio, Ralph, "Preserving Personal Care and Household Products," Household and Personal Products Industry, v38, n5, p69, May 2001, ISSN: 0090–8878.

* cited by examiner

*Primary Examiner*—Cheryl A. Juska
*Assistant Examiner*—Jenna-Leigh Befumo
(74) *Attorney, Agent, or Firm*—Pauley Petersen & Erickson

(57) ABSTRACT

This invention relates to a disposable wash cloth. The disposable wash cloth includes an aqueous solution incorporated onto a basehseet. The aqueous solution includes a fragrance, at least one mild surfactant, at least one moisturizer, and at least one preservative. The disposable wash cloth is capable of being heated to a select temperature at least twice while maintaining chemical stability.

17 Claims, No Drawings

DISPOSABLE WASH CLOTH AND METHOD OF USING

BACKGROUND OF THE INVENTION

Disposable articles of the type generally known as disposable washcloths, wet wipes or cleansing wipes for use in a variety of personal hygiene care applications are well known in the art. A variety of such products that utilize a basesheet impregnated with a solution adapted to cleanse, moisturize and/or revitalize the skin are commercially available. Such products, also known as bathing or bath kits, often contain multiple sheets impregnated with a solution that can be heated to a temperature approximately equal to or above normal body temperature about 98° F. (about 37° C.). Because of the efficiency and ease of use, these products have been adopted for use in hospitals and long-term care facilities to provide a less messy and a less time consuming means for bathing a bed-bound patient. In recent years, the number of elderly adults who remain in their homes or living with an adult caretaker has increased. As a result, home health care providers are beginning to adopt disposable washcloths as means to ease the time and logistical burdens of caring for an elderly person who may not be able to use the typical home bathroom facilities to bathe.

The bathing kits currently available are typically packaged for a single use. In other words, such bathing kits are intended to be heated once and all of the individual sheets used during the course of a single bath. However, in the home setting, care providers typically do not follow the same protocol as caregivers in a hospital or long-term care facility setting. Thus, a home care provider may only use a portion of a bath kit often retaining the remaining sheets for future use. However, the solutions and the basesheets in these bathing kits have not been formulated to withstand multiple heatings. Therefore, the solution and basesheets are susceptible to thermal degradation of critical components such as the preservatives, surfactants, and/or fragrances that may compromise the integrity and efficacy of the bathing kit. In addition, undesirable chemical breakdown products may be generated by multiple heatings of the solution and basesheets that may result in malodor and/or may result in irritation of the skin.

SUMMARY OF THE INVENTION

Now, a disposable washcloth article has been developed that may be heated to a select temperature at least twice while maintaining chemical stability. By selecting a basesheet and solution formulation that is resistant to thermal degradation, the disposable washcloth article can be heated multiple times without the creation of undesirable chemical breakdown products. Such undesirable chemical breakdown products often may cause skin irritation and/or malodor or may reduce the efficacy of the product to efficiently clean and/or moisturize the skin surface. In addition, the care provider has more flexibility in deciding how many individual washcloths to use in any given bathing situation.

Briefly, this invention relates to a disposable article for use as a washcloth. The disposable article includes an aqueous solution incorporated onto a basehseet. The aqueous solution includes a fragrance, at least one mild surfactant, at least one moisturizer or humectant, and at least one preservative. The disposable article is capable of being heated to a select temperature at least twice while maintaining chemical stability.

In another embodiment, the disposable article includes an aqueous solution incorporated onto a nonwoven basesheet to form a moist basesheet. The aqueous solution includes a fragrance, at least one mild surfactant, at least one moisturizer or humectant, and at least one preservative. The disposable article is capable of being heated to a temperature of from about 37° C. to about 75° C. at least twice while maintaining chemical stability.

In a further embodiment, the invention relates to a disposable article including an aqueous solution incorporated onto a nonwoven basesheet to form a moist basesheet. The aqueous solution includes a fragrance, at least one mild surfactant that is thermostable to at least about 75° C., at least one moisturizer or humectant that is thermostable to at least about 75° C., and at least one preservative that is thermostable up to at least about 75° C. The fragrance includes at least two aroma compounds each having at least one base note which is thermostable up to at least about 75° C. At least one of the aroma compounds is an essential oil. The disposable article is capable of being heated to a temperature of from about 37° C. to about 75° C. at least twice while maintaining chemical stability.

A method of using the present invention includes providing a plurality of individual basesheets having an aqueous solution incorporated thereon in a package. The package is heated to a select temperature and a number of individual basesheets are removed from the package for use. The package containing the remaining individual basesheets may then be reheated at least once while maintaining chemical stability.

DETAILED DESCRIPTION OF THE PREFERRED EMBODIMENTS

The disposable article of the present invention includes a basesheet and an aqueous solution incorporated onto the basesheet. Suitably, the disposable article is capable of being heated to a select temperature at least twice while maintaining chemical stability. As used herein the term "chemical stability" means that the disposable article may be heated at least twice without the creation of undesirable chemical breakdown products that may cause skin irritation and/or malodor or that may reduce the efficacy of the product overall to efficiently clean and/or moisturize the skin surface. Examples of undesirable breakdown products include formaldehyde, sulfur containing compounds which may cause malodor and other byproducts of interactions between the individual compounds in the aqueous solution and residual compounds associated with the basesheet.

Specifically, the disposable article is capable of being heated to a temperature of from about 37° C. to about 75° C. at least twice while maintaining chemical stability. More specifically, the disposable article is capable of being heated to a temperature of from about 37° C. to about 75° C. for a total of five (5) minutes in a sequence of two or more cycles while maintaining chemical stability. Most specifically, the disposable article is capable of being heated to about 75° C. in a sequence of six (6) cycles, each cycle having a duration of 1.5 minutes while maintaining chemical stability.

Advantageously, the basesheet is water insoluble and low linting so as not to catch on calloused or dry skin. The basesheet should be resistant to degradation by the chemicals, particularly the surfactants, in the aqueous solution and resistant to thermodegradation resulting from at least two heatings up to a temperature of at least about 120° C. As used herein, the terms "resistant to thermodegradation" and "thermostable" are used to defined materials that do not produce undesirable chemical breakdown products upon repeated heating to a select temperature. The basesheet should have adequate tensile strength for durability during the washing of the body and should be non-abrasive. Additional characteristics of the basesheet include adequate loft and porosity to provide sufficient fluid retention properties so that the incorporated aqueous solution remains essentially in the basesheet and does not significantly pool or puddle at the bottom of the package containing the disposable article. The basesheet should also have a sufficient thickness to provide a plush feel on the skin and should be dimensioned to provide an adequate cleaning surface. The basesheet may be dimensioned to have a square or rectangular shape. Alternatively, the basesheet may be dimensioned to have an irregular shape to accommodate packaging and dispensing needs. Preferably, the basesheet of the disposable article has a width dimension of at least about 12 inches (4.72 cm) and a length dimension of at least about 12 inches (4.72 cm). More preferably, the basesheet should have a width dimension of at least about 9 inches (3.54 cm) and a length dimension of at least about 9 inches (3.54 cm). And most preferably, the basesheet should have a width dimension of at least about 8 inches (3.15 cm) and a length dimension of at least about 8 inches (3.15 cm).

The basesheet may be made from any suitable synthetic or natural material or blend thereof that is durable, non-abrasive, fluid retentive and disposable. Examples of appropriate synthetic materials include nonwoven materials such as hydroentangled, needlepunched, meltblown, coform, themobonded, spunbond, airlaid, water laid, or carded materials comprising a polymer fibers. Suitable polymer fibers include polyolefins such as polyethylene and polypropylene, rayons, polyesters, dacron, nylon, fortrel, kodel, viscose, viscose-lyocell and mixtures thereof. Examples of suitable natural materials include woven and nonwoven materials made of natural fibers such as cotton, wood pulp or mixtures thereof. One example of a blended material suitable for use as a basesheet is a coform material made of a blend of wood pulp fibers and polypropylene fibers. Suitably, the synthetic fibers have not been treated or processed with sulfur containing compounds. Suitably, the fibers used in manufacturing the basesheet material should contain less than about 35 parts per million sulfur (expressed as ppm carbon disulfide). Furthermore, the fibers used in manufacturing the basesheet should contain less than about 25 ppm formaldehyde. It has been noted that reducing or eliminating the presence of sulfur containing compounds and formaldehyde in the basesheet material aids in preventing malodor upon heating of the basesheet material.

Preferably, the basesheet is a nonwoven material. More preferably, the basesheet is a nonwoven material made up of a blend of two or more synthetic fibers. Most preferably, the basesheet is a nonwoven material made up of either a blend of rayon and polyester fibers or a blend of viscose-lyocell and polyester. The basesheet material may include from about 25% to about 75% polyester fibers. Suitably, the basesheet material is made up of about 30% polyester fibers. More suitably, the basesheet material is made up of about 50% polyester fibers. The basesheet material may include from about 25% to about 75% rayon or viscose-lyocell fibers. More specifically, the basesheet material includes about 50% rayon or viscose-lyocell fibers. Most specifically, the basesheet material is a nonwoven material made up of a blend of about 50% polyester fibers and about 50% viscose-lyocell fibers.

Suitably, the basesheet should retain a sufficient quantity of the incorporated aqueous solution to form and maintain a moist disposable article. As used herein, the term "moist" means that the basesheet retains a sufficient amount of the aqueous solution to make the basesheet slightly to moderately wet. For example, the disposable article should feel damp to the skin but an excess of the incorporated aqueous solution does not drip or run-off the basesheet creating a mess. Thus, when individual sheets are removed from their packaging they are moist and ready to use.

The aqueous solution includes a fragrance, at least one mild surfactant, at least one moisturizer or humectant, and at least one preservative. Advantageously, the aqueous solution contains from about 0.02% to at about 0.09% fragrance, from about 0.4% to about 0.6% mild surfactant, from about 0.5% to about 1.5% moisturizer, and from about 0.2% to about 0.55% preservative. As used herein, the term "mild surfactant" is defined to mean that the surfactant should be gentle, causing little or no irritation to the skin.

Advantageously, each individual compound in the aqueous solution should be resistant to chemical degradation when exposed to multiple heatings. The individual compounds should also be chemically stable to multiple heatings in combination with the other compounds of the aqueous solution and the basesheet. Interaction of the individual compounds, although resistant to chemical degradation when exposed to multiple heatings, with each other and/or the basesheet can result in an aqueous solution that is not chemically stable when exposed to multiple heatings. Thus, the individual compounds included in the aqueous solution should be selected such that they are compatible with each other in solution and compatible with the basesheet material in order to provide a basesheet having an aqueous solution incorporated thereon that is capable of being heated to a select temperature at least twice while maintaining chemical stability.

Typically, the fragrance will contain a blend of aroma compounds and inert carrier compounds that do not contribute to the scent of the fragrance. Aroma compounds usually include compounds described as having top notes, middle notes and/or base notes. Top note compounds are the least resistant to heating and will generally flash off or volatilize quickly upon exposure to elevated temperatures. Middle note compounds, also known as aldehydic lifters, are more stable and longer lasting, but are still prone to dissipation over a relatively short period of time or upon repeated exposure to elevated temperatures. Base note compounds are those compounds often characterized as having a "heavy" scent and are the most resistant to dissipation over time, lingering for long periods. One class of base note compounds includes essential oils. Generally, a fragrance may be made of from about 5% to about 50% aroma compounds. Typically, a fragrance may include from about 50% to about 95% inert carrier compounds. Suitable inert carrier compounds can include dipropylene glycol.

Preferably, the fragrance includes at least two aroma compounds. More preferably, the fragrance includes at least two aroma compounds each having at least one base note that is thermostable up to at least about 75° C. Most preferably, at least one of the aroma compounds is an essential oil. Suitable essential oils include ylang ylang, coriander, grapefruit, lavender, white thyme, mandarin orange oil, tuberose, jasmine, lavadin, galbanum, clove leaf, eucalyptus, and geraniol. Other essential oils suitable for use in the present invention include sandalwood, musk, orris root, jasmine, rose, lily of the valley, bergamot, orchid, ginger, nutmeg, lemongrass, tumeric, rosemary, clove, chamomile, achillea, thulasi and cedar. Additionally, other essential oils known in the art can also be used. Preferably, the fragrance contains from about 0.01% to about 1% of an essential oil. Optionally, the fragrance is protected with a cyclodextrin inclusion complex. Examples of fragrance inclusion complexes can include molecular entrapment of the base note compounds within a cyclodextrin complex or encapsulation of the fragrance within a gelatin capsule. The more preferred is the cyclodextrin inclusion complex. The use of an inclusion complex is more desirable to reduce the degree of volatilization of the fragrance upon repeated exposure to elevated temperatures. The cyclodextrin inclusion complex also servers to protect the chemical integrity of the fragrance notes until use.

Typically, the fragrance is dispersed and mixed with a cyclodextrin powder such that the fragrance is entrapped within the open cyclodextrin structure. The resulting water dispersible paste is then added to the solution to be incorporated onto the basesheet. One example of a suitable cyclodextrin complex material is a hydroxypropylbetacyclodextrin which is available under the trade name KLEPTOSE HP from Roquette America, Inc., having an office 1417 Exchange Street, P.O. Box 6647, Keokuk, Iowa 52632. Preferably, the aqueous solution will contain from about 0.3% to about 0.8% of the cyclodextrin inclusion complex.

The aqueous solution advantageously includes at least one mild surfactant. Suitably, the surfactant may be a mild amphoteric surfactant or a mild anionic surfactant. Typically, the aqueous solution will include only one class of surfactants, either amphoterics or anionics. Suitably, the selected surfactant is thermostable up to about 75° C. Where the aqueous solution includes two or more surfactants, at least one of the surfactants is thermostable up to about 75° C. The surfactant should generally be low-foaming thereby preventing excessive foam formation during heating, leakage of the solution from the packaging during heating and providing a less messy, fast-drying bath for bed-bound patients. Specifically, the aqueous solution should include from about 0.4% to about 0.6% mild surfactant.

One suitable mild amphoteric surfactant for use in the present invention is disodium cocoamphodiacetate. Disodium cocoamphodiacetate is available under the trade name MACKAM 2C from The McIntyre Group, Ltd., having an office at 24601 Governors Highway, University Park, Ill. 60466.

Mild anionic surfactants suitable for use in the present invention include sodium cocopolyglucose tartrate, disodium cocopolyglucose citrate, disodium cocopolyglucose sulfosuccinate and arginine cocoate. The cocopolyglucose surfactants may be obtained under the trade names EUCAROL AGE-ET, EUCAROL AGE-EC and EUCAROL AGE-SS, respectively, from Pilot Chemical Company, having an office at 11756 Burke Street, Santa Fe Springs, Calif. 90670. Arginine cocoate is available under the trade name AMINOSOAP AR-12 from Ajinomoto U.S.A., Inc., having an office at Country Club Plaza, West 115 Century Road, Paramus, N.J. 07652.

The aqueous solution advantageously includes at least one moisturizer. Suitably, the aqueous solution should include about 0.5% to about 1.5% moisturizer. Suitable moisturizers for use in the present invention include glycerin and pyrrolidone carboxylic acid and salts thereof. Pyrrolidone carboxylic acid is available under the trade name AJIDEW N-50 from Ajinomoto U.S.A., Inc. Other moisturizers known in the art can also be used in the present invention.

The aqueous solution also includes at least one preservative. The preservative should be thermostable up to about 75° C. Advantageously, when the aqueous solution includes two or more preservatives, at least one of the preservatives is thermostable up to about 75° C. Suitably, the preservative should be effective against yeast, particularly *Candida albicans*, molds such as *A. niger* and *T. luteus,* fungi and bacteria, particularly *S. aureus, E. coli, E. cloacae, P. aeruginosa,* and *B. cepacia*. The preservative should be present in an amount in the aqueous solution sufficient to prevent the growth of yeast, mold, fungi, and bacteria. Specifically, the aqueous solution should include from about 0.2% to about 0.55% preservative.

One suitable preservative material for use in the present invention is a 95:5 blend of 1,3-di-(hydroxymethyl)-5,5-dimethylhydantoin (also known DMDM hydantoin) and 3-iodo-2-propynyl butyl carbamate (also known as IPBC). This preservative is available under the trade name GLYDANT PLUS from the Lonza Group, having an office at 17-17 Route 208, Fair Lawn, N.J. 07410. Typically, the aqueous solution may contain about 0.3% of a 95:5 blend of DMDM hydantoin and IPBC.

Another suitable preservative for use in the present invention is a 35:0.5:64.5 blend of DMDM hydantoin, IPBC and glycerin. This preservative is available under the trade name MACKSTAT H-66 from The McIntyre Group, Ltd., having an office at 24601 Governors Highway, University Park, Ill. 60466. Preferably, the aqueous solution should contain from about 0.5% to about 0.7% of a 35:0.5:64.5 blend of DMDM hydantoin, IPBC and glycerin. Other preservatives known in the art can also be used.

Additional preservatives suitable for use in the present invention in combination with a blend of DMDM hydantoin and IPBC include methyl paraben, disodium ethylenediamine tetraacetic acid (also known as disodium EDTA), and diazolidinyl urea (available under the trade name of GERMALL II from ISP Sutton Laboratories, having an offices at 116 Summit Avenue, P.O. Box 837, Chatham, N.J. 07928). Optionally, the aqueous solution may include from about 0.1% to about 0.2% methyl paraben in combination with a DMDM hydantoin and IPBC blend. Alternatively, the aqueous solution may contain from about 0.1% to about 0.25% disodium EDTA in combination with a DMDM hydantoin and IPBC blend. Suitably, the aqueous solution may include from about 0.15% to about 0.3% diazolidinyl urea in combination with a blend of DMDM hydantoin and IPBC. Other suitable materials known in the art can also be used.

Another preservative system suitable for use in the present invention includes combinations of methyl paraben and/or disodium EDTA with diazolidinyl urea. Advantageously, methyl paraben and/or disodium EDTA should be used in a ratio with diazolidinyl urea sufficient to inhibit the growth of yeast, mold, fungi and bacteria. Specifically, the ratio of methyl paraben and/or disodium EDTA to diazolidinyl urea should be about 1:3.

The aqueous solution can contain additional compounds to enhance to the feel, efficacy and moisturizing characteristics of the disposable article. For example, the aqueous solution may contain a skin lubricity agent. The skin lubricity agent is used to promote wetting of the skin during bathing and to provide a smooth or silky feeling to the aqueous solution as it is applied to the skin. One skin lubricity agent suitable for use in the present invention is a blend of polyethylene glycol 400 and PEG 8 dimethicone. A suitable blend is available under the trade name ULTRASIL COPOLYOL 7 available from Noveon, Inc., having an office at 9911 Brecksville Road, Cleveland, Ohio 44141. Other suitable skin lubricity agents include dimethicone, simethicone and polyethylene glycol 400. Optionally, the aqueous solution may contain from about 0.5% to about 0.8% of a skin lubricity agent.

The aqueous solution can also include a humectant. The addition of a humectant helps maintain an effective level of moisture, which minimizes dehydration associated with mature skin. Suitable humectants for use in the present invention include propylene glycol, glycerin, sodium polyaspartate, muccopolysaccharides, sodium PCA, sorbitol, mannitol, dextrin, soluble collagen, maltodextrin, xylitol, sodium lactate, maltitol, honey, glycereth-26, aceamide MEA, lactamide MEA, PEG-12, and ethoxydiglycol. Other suitable humectants known in the art can also be used. For example, the aqueous solution can optionally include from about 0.5% to about 1.5% propylene glycol and/or from about 0.3% to about 2% glycerin. If used alone, glycerin may be preferred over propylene glycol which can be dehydrating to mature skin.

The aqueous solution can also include aloe and/or skin vitamins such as Vitamin E (tocopheryl acetate) and Dexpanthenol. The addition of useful levels of aloe and/or skin vitamins help to soothe and replenish dry devitalized skin. Suitably, the aqueous solution may contain from about 0.0025% to about 1.5% of aloe and/or skin vitamins. One skin vitamin suitable for use in the present invention is tocopheryl acetate blended with polysorbate 20. A suitable blend of this material may be obtained under the trade name MIRACARE SML E/5 from Rhodia Inc., 259 Prospect Plains Road CN750, Cranbury, N.J. 08512.

Method

In one embodiment of the present invention a package containing a plurality of individual basesheets having an aqueous solution incorporated thereon is provided. Advantageously, the package is made of materials that demonstrate chemical stability and physical integrity after multiple heatings to a temperature from about 37° C. to about 75° C. As used herein the term "physical integrity" is defined to mean that the package material is resistant to leaks, does not become brittle, combust or otherwise degrade. Suitably the package should be resealable or recloseable in order to facilitate multiple heating and use cycles and to maintain the remaining individual basesheets in a moist condition. By providing a package containing a plurality of individual basesheets having an aqueous solution incorporated thereon that may be reheated, the consumer is provided with greater flexibility by eliminating the need to use an entire package in a single use.

One method of using the present invention includes providing a package containing a plurality of individual basesheets having an aqueous solution incorporated thereon. The package containing the individual basesheets is heated to a select temperature above 37° C. At least one of the individual basesheets is removed from the package for use. The package containing the remaining individual basesheets may then be reheated at a later time. The package can be heated again to a temperature above 37° C. while maintaining chemical stability.

The package containing the individual basesheets may be initially heated to a temperature of from about 37° C. to about 75° C. Suitably, the package containing the individual basesheets is initially heated to a temperature of from about 45° C. to about 70° C. More suitably, the package containing the individual basesheets is initially heated to a temperature of from about 55° to about 65° C.

The package containing the remaining individual basesheets may be reheated at least once to a temperature of from about 37° C. to about 75° C. Advantageously, the package containing the remaining individual basesheets is reheated at least once to a temperature of from about 45° C. to about 70° C. Most advantageously, the package containing the remaining individual basesheets is reheated at least once to a temperature of from about 55° to about 65° C.

Another method of using the present invention includes providing a package containing a plurality of individual basesheets having an aqueous solution incorporated thereon. The package containing the individual basesheets is heated for a select time. At least one of the individual basesheets is removed from the package for use. The package containing the remaining individual basesheets may then be reheated at a later time for a select time while maintaining chemical stability.

Specifically, the package containing the individual basesheets is heated for at least about 10 seconds. More specifically, the package containing the individual basesheets is heated for not greater than about 120 seconds. Most specifically, the package containing the individual basesheets is heated for about 90 seconds.

Suitably, the package containing the remaining individual basesheets is reheated at least once for at least about 10 seconds. More suitably, the package containing the remaining individual basesheets is reheated at least once from about 10 seconds to 45 seconds. Most suitably, the package containing the remaining individual basesheets is reheated at least once from about 10 seconds to about 30 seconds.

Test Methods

Preservative Efficacy

Test articles are prepared by incorporating an aqueous solution including a fragrance, at least one mild surfactant, at least one moisturizer and at least one preservative according to the disclosure above onto individual sheets of a needle-punched nonwoven basesheet made of a blend of 50% polyester fibers and 50% viscose lyocell fibers. The aqueous solution was incorporated onto the basesheets at a level equivalent to about 260% of the basesheet weight. The basesheets having the aqueous solution incorporated thereon were subjected to a sequence of six heating cycles, each cycle having a duration of about 90 seconds. The basesheets were allowed to cool to room temperature between each heating cycle for about three hours. The basesheets having the aqueous solution incorporated thereon was then subjected to a standardized protocol for testing preservative efficacy.

Prior to inoculation, the initial level of viable microorganism present in each test article is determined. One gram of test article is placed in 99 milliliters of diluent (either 0.9% saline solution or 0.9% saline solution containing 0.05% polysorbate 80 as noted below) and processed in a stomacher for one minute at medium speed. Ten milliliters of this suspension is plated between 3 plates containing a suitable agar material known in the art to represent a 1:10 test article dilution and 1.0 milliliter is transferred to an additional plate for a 1:100 dilution. Two separate sets of plates should be prepared as above. One set is prepared and incubated for 3–5 days at from about 30° C. to about 35° C. for bacteria recovery. The second set of plates is prepared of yeast/mold recovery and is incubated for 5–7 days at from about 20° C. to about 25° C. After incubation a plate count is taken and multiplied by the dilution factor to determine the number of viable microorganisms present (in Colony Forming Units per gram of test article or CFU/g test article).

Six individual basesheets are inoculated with 0.1 milliliters of a challenge suspension, slightly spread over a one-gram area. Final challenge concentrations (in CFU/g test article) should be $1.0\times10^6$ to $9.9\times10^6$ bacteria inoculums, $1.0\times10^5$ to $9.9\times10^5$ yeast inoculum, or $1.0\times10^5$ to $9.9\times10^5$ mold inoculums. Bacteria inoculum suspensions are prepared in 0.9% saline solution for *Escherichia coli, Pseudomonas aeruginosa, Staphylococcus areus, Enterobacter cloacae,* and *Burkholderia cepcacia.* Yeast inoculum suspensions are prepared in 0.9% saline solution for *Candida albicans* and mold inoculum suspensions were prepared in a 0.9% saline solution containing 0.05% polysorbate 80 for *Aspergillus niger* and *Talaromyces lutues*. The viable number of microorganisms in each suspension is determined by any suitable plate count procedure known in the art, and the initial concentration of microorganisms per gram test article (0-hour inoculum level) is calculated. The O-hour inoculum level is used as a baseline for calculating the reduction in number of organisms over time. Inoculated test articles are maintained at from about 20° C. to about 25° C. for the duration of the study.

Enumeration of the remaining viable bacterial and fungal population in the inoculated test articles is conducted at 7, 14 and 28 days post-inoculation. At each time interval, the inoculated one gram area of a single basesheet is aseptically removed and transferred to a sterile stomacher bag containing 99 milliliters of diluent (0.9% saline or 0.9% containing 0.05% polysorbate 80 as noted above). The test article is processed in a stomacher for one minute at medium speed. Ten milliliters of this suspension is distributed between 3 plates containing a suitable agar medium known in the art to represent the 1:10 test article dilution and 1.0 milliliters is transferred to an additional plate containing a suitable agar medium known in the art as the 1:100 dilution. Following incubation of the test plates as noted above, the plates are observed and the CFU's counted. The number of organisms observed is multiplies by the dilution factor of the plate to give the number of viable organism per gram of test article at each time interval.

The formulation is deemed adequately preserved if: (a) there is at least a 99.9% reduction of vegetative bacteria within 7 days following each challenge, and no increase for the duration of the test period; and (b) there is at least a 90% reduction of yeasts and molds within 7 days following each challenge, and no increase for the duration of the test period. The preservative is effective in the product if there is not less than a 2.0 log reduction in bacteria from the initial calculated count at 14 days, and no increase from the 14 day count at 28 days and there is no increase in the initial calculated count of yeast and mold at 14 and 28 days. No increase is defined as not more than 0.5 $\log_{10}$ units higher than the previous values measured.

Fragrance Stability

Test and control articles are prepared by incorporating an aqueous solution including a fragrance, at least one mild surfactant, at least one moisturizer and at least one preservative according to the disclosure above onto individual sheets of a needle-punched nonwoven basesheet made of a blend of 50% polyester fibers and 50% viscose lyocell fibers. The aqueous solution was incorporated onto the basesheets at a level equivalent to about 260% of the basesheet weight.

The basesheets were placed in a suitable container and were subjected to a sequence of four heating cycles, each cycle having a duration of about 30 seconds. Prior to the first heating the container was opened and vented. The container and basesheets were allowed to cool for three hours between each heating cycle. After the fourth heating cycle, the container and basesheets were allowed to cool for 3 hours. A trained olfactory sensory analyst then evaluates the sample for fragrance note retention as compared to an unheated control article. A test article is deemed to have good fragrance retention if the olfactory sensory analyst detects little or no reduction in fragrance note intensity between the heated test article and the unheated control article.

Chemical Stability

Test articles are prepared by incorporating an aqueous solution of individual components according to the disclosure above onto individual sheets of a needle-punched nonwoven basesheet made of a blend of 50% polyester fibers and 50% viscose lyocell fibers. The aqueous solution was incorporated onto the basesheets at a level equivalent to 260% of the basesheet weight. The basesheets having the aqueous solution incorporated thereon was subjected to a sequence of six heating cycles, each cycle having a duration of about 90 seconds. The basesheets were allowed to cool to room temperature between each heating cycle.

The test articles are analyzed by techniques known in the art such as infrared spectroscopy, liquid chromatography and gas chromatography mass spectroscopy to determine if any degradation of the component had occurred. The components are deemed to be chemically stable if either no significant degradation chemicals are detected or there is no significant reduction in the concentration of the component before and after heating.

EXAMPLES

Aqueous solutions including a fragrance, at least one mild surfactant, at least one moisturizer and at least one preservative was prepared as follows and incorporated onto a needle-punched nonwoven basesheet made of a blend of 50% polyester fibers and 50% viscose lyocell fibers. All of the examples below was prepared using a base formula that includes water, a mild surfactant (MACKAM 2C), a moisturizer (glycerin), a skin vitamin (MIRACARE SML E/5), aloe, a fragrance, and a solubilizing agent for the fragrance (polysorbate 20). Each of the individual examples were prepared with a different preservative system. The solutions were incorporated onto individual sheets of a needle-punched nonwoven basesheet made of a blend of 50% polyester fibers and 50% viscose lyocell fibers and were successfully tested for preservative efficacy and fragrance stability using the methods noted above.

Example 1

An aqueous solution, including the base formula above, was prepared utilizing a preservative system having a 95:5 blend of 1,3-di-(hydroxymethyl)-5,5-dimethylhydantoin and 3-iodo-2-propynyl butyl carbamate (GLYDANT PLUS). Propylene glycol was added to the solution to solubilize the GLYDANT PLUS. The solution was incorporated onto individual sheets of a needle-punched nonwoven basesheet made of a blend of 50% polyester fibers and 50% viscose lyocell fibers and was successfully tested for preservative efficacy and fragrance stability using the methods noted above.

| Class | Compound | Percent (%) |
|---|---|---|
| | Deionized water | 96.9975 |
| Solubilizing agent | Propylene glycol | 1.5 |
| Preservative | GLYDANT PLUS | 0.3 |
| Mild surfactant | MACKAM 2C | 0.5 |

-continued

| Class | Compound | Percent (%) |
|---|---|---|
| Moisturizer | Glycerin | 0.4 |
| Skin vitamin | MIRACARE SML E/5 | 0.01 |
| Aloe | Aloe | 0.0025 |
| Fragrance | Fragrance | 0.06 |
| Solubilizing agent | Polysorbate 20 | 0.23 |
| | | 100 |

Example 2

An aqueous solution, including the base formula above, was prepared utilizing a preservative system having a 35:0.5:64.5 blend of 1,3-di-(hydroxymethyl)-5,5-dimethylhydantoin, 3-iodo-2-propynyl butyl carbamate, and glycerin (MACKSTAT H-66) and disodium ethylenediamine tetraacetic acid (disodium EDTA). The solution was incorporated onto individual sheets of a needle-punched nonwoven basesheet made of a blend of 50% polyester fibers and 50% viscose lyocell fibers and was successfully tested for preservative efficacy and fragrance stability using the methods noted above.

| Class | Compound | Percent (%) |
|---|---|---|
| | Deionized water | 98.0475 |
| Preservative | MACKSTAT H-66 | 0.6 |
| Preservative | Disodium EDTA | 0.15 |
| Mild surfactant | MACKAM 2C | 0.5 |
| Moisturizer | Glycerin | 0.4 |
| Skin vitamin | MIRACARE SML E/5 | 0.01 |
| Aloe | Aloe | 0.0025 |
| Fragrance | Fragrance | 0.06 |
| Solubilizing agent | Polysorbate 20 | 0.23 |
| | | 100 |

Example 3

An aqueous solution, including the base formula above, was prepared utilizing a preservative system containing a diazolidinyl urea (GERMALL II), disodium ethylenediamine tetraacetic acid (disodium EDTA) and methyl paraben. The solution was incorporated onto individual sheets of a needle-punched nonwoven basesheet made of a blend of 50% polyester fibers and 50% viscose lyocell fibers and was successfully tested for preservative efficacy and fragrance stability using the methods noted above.

| Class | Compound | Percent (%) |
|---|---|---|
| | Deionized water | 98.1675 |
| Preservative | GERMALL II | 0.3 |
| Preservative | Disodium EDTA | 0.15 |
| Preservative | Methyl paraben | 0.18 |
| Mild surfactant | MACKAM 2C | 0.5 |
| Moisturizer | Glycerin | 0.4 |
| Skin vitamin | MIRACARE SML E/5 | 0.01 |
| Aloe | Aloe | 0.0025 |
| Fragrance | Fragrance | 0.06 |
| Solubilizing agent | Polysorbate 20 | 0.23 |
| | | 100 |

While the invention has been described in conjunction with several specific embodiments, it is to be understood that many alternatives, modifications, and variations will be apparent to those skilled in the art in light of the foregoing description. Accordingly, this invention is intended to embrace all such alternatives, modifications, and variations that fall within the spirit and the scope of the appended claims.

I claim:

1. A disposable article comprising:

a. a basesheet; and b. an aqueous solution incorporated onto said basesheet, said aqueous solution including a fragrance, at least one arginine cocoate mild surfactant, at least one moisturizer, and at least one preservative, wherein said disposable article when heated to a select temperature at least twice maintains chemical stability.

2. The disposable article of claim 1 wherein said article is moist.

3. The disposable article of claim 1 wherein said basesheet is a nonwoven.

4. The disposable article of claim 3 wherein said nonwoven is formed from a blend of viscose-lyocell fibers and polyester fibers.

5. The disposable article of claim 3 wherein said nonwoven is formed from a blend of rayon fibers and polyester fibers.

6. The disposable article of claim 1 wherein said fragrance is molecularly entrapped within a cyclodextrin complex.

7. The disposable article of claim 1 wherein said fragrance includes at least two aroma compounds, each of said aroma compounds having at least one base note which is thermostable up to at least about 75° C.

8. The disposable article of claim 7 wherein at least one of said aroma compounds is an essential oil.

9. The disposable article of claim 8 wherein said essential oil is ylang ylang, coriander, grapefruit, lavender, white thyme, mandarin orange oil, tuberose, jasmine, lavadin, galbanum, clove leaf, eucalytpus or geraniol.

10. A disposable article comprising:

a. a nonwoven basesheet; and b. an aqueous solution incorporated onto said basesheet to form a moist basesheet, said aqueous solution including a fragrance, at least one arginine cocoate mild surfactant, at least one moisturizer, and at least one preservative, wherein said article when heated to a temperature of from about 37° C. to about 75° C. at least twice maintains chemical stability.

11. The disposable article of claim 10 wherein said nonwoven basesheet is formed from a blend of viscose-lyocell and polyester fibers.

12. The disposable article of claim 10 wherein at least one of said mild surfactants is thermostable to at least about 75° C.

13. The disposable article of claim 10 wherein at least one of said preservatives is thermostable to at least about 75° C.

14. A disposable article comprising:

a. a nonwoven basesheet; and b. an aqueous solution incorporated onto said basesheet to form a moist basesheet, said aqueous solution including a fragrance having at least two aroma compounds, each of said aroma compounds having at least one base note which is thermostable up to at least about 75° C., and at least one of said aroma compounds is an essential oil, at least one arginine cocoate mild surfactant which is thermostable to at least about 75° C., at least one moisturizer, and at least one preservative which is thermostable to at least about 75° C., wherein said article when heated to a temperature of from about 37° C. to about 75° C. at least twice maintains chemical stability.

15. The disposable article of claim 14 further comprising a skin lubricity agent.

16. The disposable article of claim 14 wherein said article is chemically stable to heating of up to about 5 minutes from about 37° C. to about 75° C. in a sequence of two or more cycles.

17. The disposable article of claim 14 wherein said article is chemically stable to heating at about 75° C. in a sequence of six cycles, each cycle having a duration of about 1.5 minutes.

* * * * *